United States Patent [19]

Maier, Jr.

[11] 4,110,948

[45] Sep. 5, 1978

[54] THERMAL INSULATING CLIPS FOR METAL INSULATED WALLS AND ROOFS

[76] Inventor: Adolph J. Maier, Jr., 128 W. Livingston Pl., Metairie, La. 70005

[21] Appl. No.: 776,884

[22] Filed: Mar. 11, 1977

[51] Int. Cl.[2] ..... E04B 1/62

[52] U.S. Cl. ..... 52/402; 52/403; 52/714

[58] Field of Search ..... 52/568, 569, 570, 571, 52/393, 402, 235, 508, 506, 562, 563, 403, 480, 481, 714 C, 715 C

[56] References Cited

U.S. PATENT DOCUMENTS

| | | | |
|---|---|---|---|
| 1,302,578 | 5/1919 | Murphy | 52/402 |
| 1,350,349 | 8/1920 | Walther | 52/402 |
| 1,415,273 | 5/1922 | Stevens | 52/402 |
| 1,491,198 | 4/1924 | Cassidy | 52/402 |
| 1,610,578 | 12/1926 | Murphy | 52/402 |
| 2,115,238 | 4/1938 | Stevens | 52/402 |
| 2,374,623 | 4/1945 | Sale | 52/712 |
| 3,788,021 | 1/1974 | Husler | 52/403 |

*Primary Examiner*—Ernest R. Purser
*Attorney, Agent, or Firm*—Cushman, Darby & Cushman

[57] ABSTRACT

An exterior wall or roof assembly for a building comprises parallel metal framing members supported in spaced relationship to an inner supporting structure by metal clips which are secured to the inner supporting structure and which during assembly are deformed to clamp the edges of the framing members between opposed surfaces of the clips, the opposed surfaces of the clips being thermally insulated from the framing members so that there is no metal heat flow path between the framing members and the inner supporting structure.

9 Claims, 9 Drawing Figures

THERMAL INSULATING CLIPS FOR METAL INSULATED WALLS AND ROOFS

This invention relates to wall assemblies for buildings and in particular to assemblies in which an inner metal-containing wall structure is spaced from an outer metal-containing wall structure the improvement of the present invention being directed to internal mounting means for securing the two wall structures to each other in a manner to avoid a continuous metal heat flow path between the wall structures thereby reducing heat conduction from one wall structure to the other.

BACKGROUND AND SUMMARY OF THE INVENTION

Side walls and roofs, hereinafter referred to as wall assemblies, of industrial buildings are frequently assembled on site in the form of inner and outer facings supported on elongated metal framing members or girts Typically the inner facing is assembled from metal sheets or panels while the outer facing is assembled from either metal or synthetic resin sheets or panels, and slabs of insulating material such as glass fiber batts are disposed between the facings. Heat conduction through the wall assembly is reduced by the pressure of the insulation, but in the typical construction there are various heat-flow paths through the assemblies formed by internal heat-conducting metal mounting means in thermal contact with metal components of the assembly. As an example, in one form of conventional wall construction there are inner sheet metal panels attached by self-tapping screws to the outside of a plurality of elongated steel framing members or main girts, the panels having interlocking flanges at their edges which form a series of ribs. Lighter-weight framing members or sub-girts are then attached to this inner wall structure, and finally the outer facing in the form of metal or resin siding panels are attached to the sub-girts The sub-girts lie against the ribs on the inner panels, with gaskets placed therebetween, and are secured in place by self-tapping screws which pass into the ribs and/or through the inner panels into the main girts. The metal-to-metal contact of the screw threads with the inner panels and/or with the main girts inherently provide heat conduction paths.

The present invention provides a wall assembly in which heat conduction paths between inner and outer metal components are avoided by the use of special clamp-type mounting assemblies having opposed relatively non-conducting clamping surfaces which tightly engage one of the metal components without the aid of screws or other fasteners which would effect metal-to-metal contact. A preferred form of mounting assembly includes a metal clip having a body portion which can be attached to one wall component by any conventional means such as a screw and end portions each of which can be folded inwardly toward the body portion. The clips are initially constructed with their ends only partially folded. During assembly a special tool is used to force the ends into their final clamping position. The thermal insulation is preferably in the form of small blocks of insulating material clamped between the clip ends and the wall component, the blocks being first positioned on the wall component and then clamped in place by deformation of the clip ends. In an alternate construction the blocks may be secured to the clips before the clip ends are deformed to their final positions.

The clip assemblies may also be designed as a releasable fastener which will separate from the wall component which is clamped by the deformable clip ends in the event of an explosion or other pressure rise in the building. In this embodiment the clip ends are constructed with reduced rigidity so that the ends will unfold if excessive outward pressure is applied to the outer wall components.

In one form of conventional construction the wall component to which the special clip is clamped is an elongated sheet metal framing member which is transverse cross-section is hat-shaped in the sense that the cross-section exhibits a central channel and a lateral flange projecting from each wall of the channel at the open end of the latter. In the assembled position the body of the clip spans the open end of the channel and overlies one surface of each lateral flange. As part of the assembly method each end portion of the clip is folded toward the body thereby clamping each of the lateral flanges of the framing member between the clip body and one of the end portions of the clip.

DETAILED DESCRIPTION

The invention will be further understood from the following detailed description together with the drawings in which.

Figure 1:
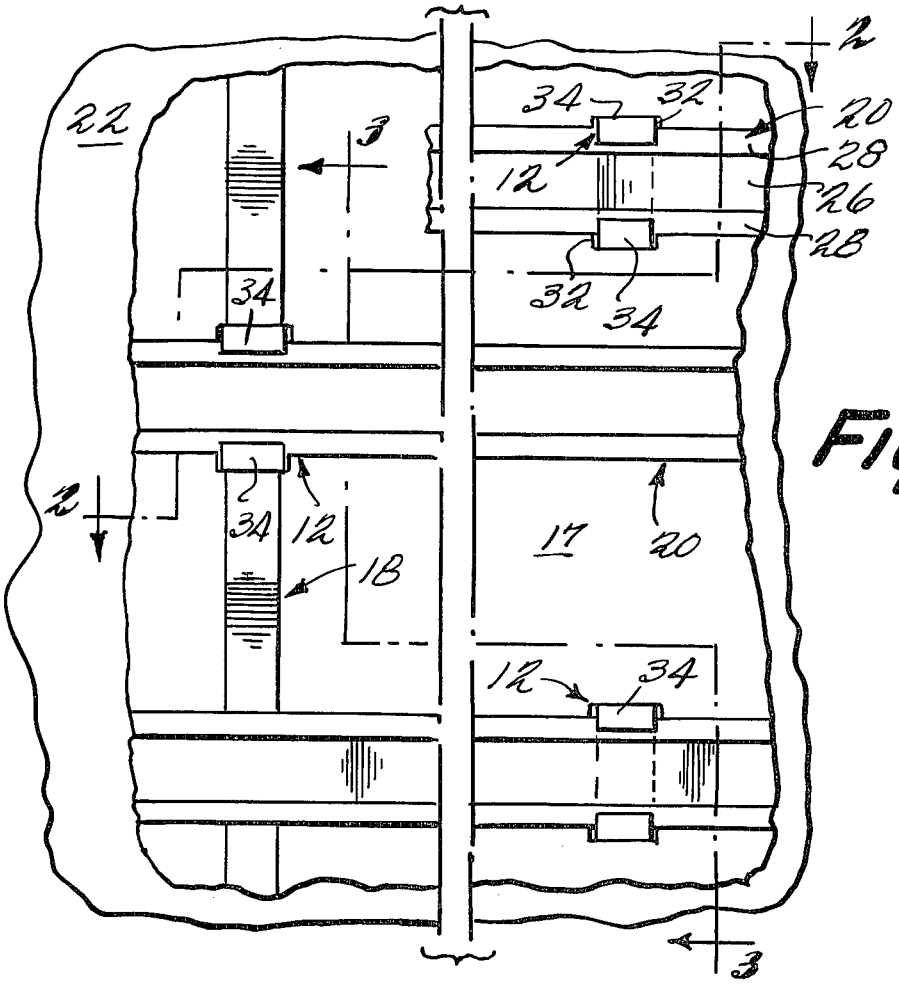
FIG. 1 is an elevational view, partly broken away, of a wall assembly embodying the special mounting means of the present invention.
Figure 2:
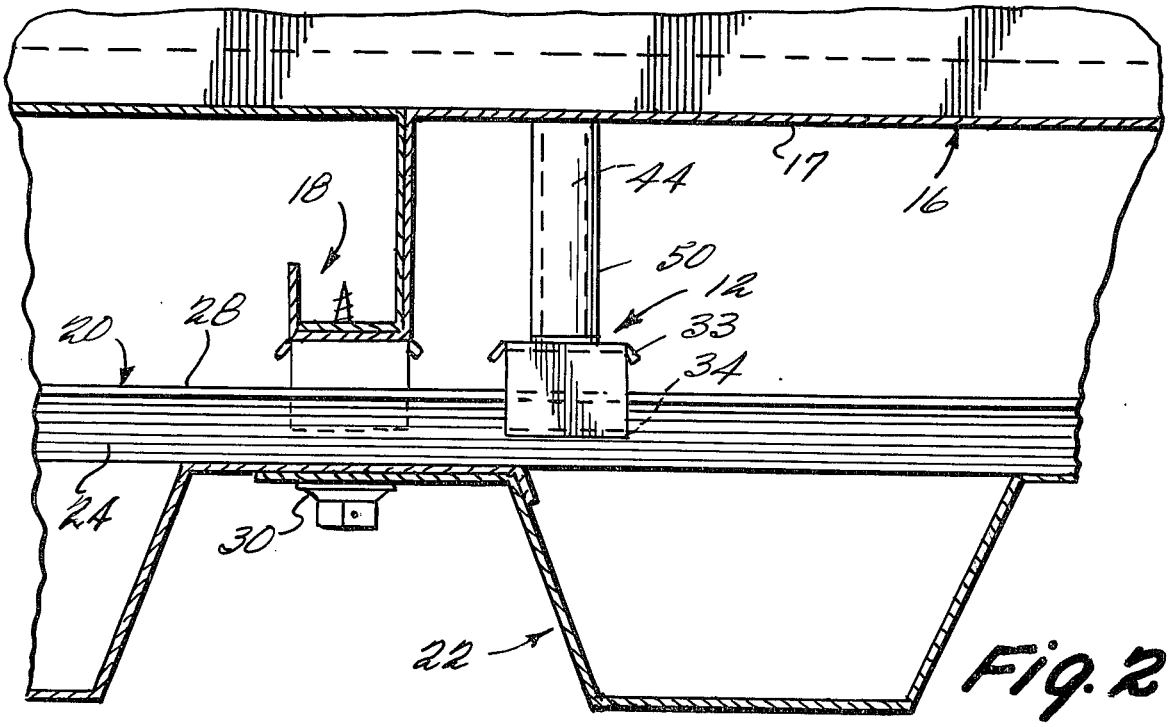
FIG. 2 is a horizontal sectional view of the wall assembly taken on the line 2—2 of FIG. 1.
Figure 3:
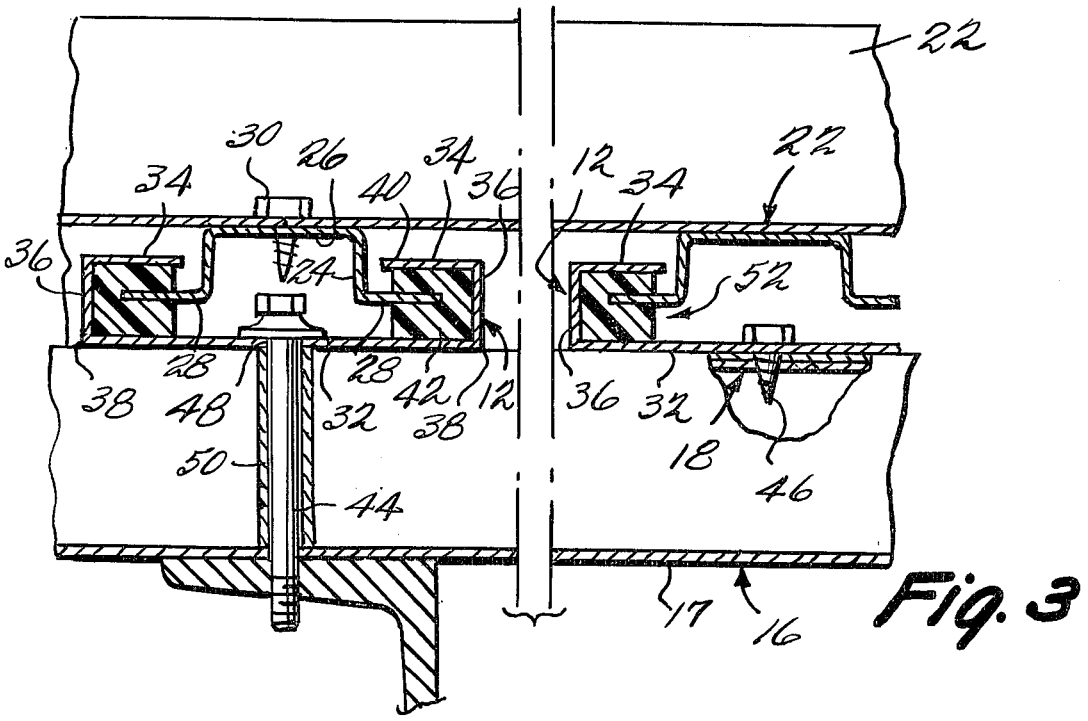
FIG. 3 is a vertical sectional view of the wall assembly taken on the line 3—3 of FIG. 1.

Referring to FIGS. 1, 2 and 3 there is shown a side wall assembly 10 in which the special non-conducting mounting means of the present invention is shown in the form of clips 12 which mount an outer wall structure to an inner wall structure. The inner wall structure includes a plurality of vertically spaced-apart horizontal main framing members or main girts 14 which in the illustrated embodiment are channel-shaped in transverse cross-section. These main girts 14 are attached to and supported by other structural components (not shown). The inner wall structure also includes a plurality of sheet metal liner panels 16 having planar faces 17 and L-shaped inter-locking edges which form ribs 18. Alternatively the liner panels 16 can be corrugated sheets arranged with overlapping edges.

The outer wall structure includes a plurality of vertically spaced-apart horizontal light-weight framing members or sub-girts 20 and a plurality of exterior metal siding panels 22. The sub-girts are sheet metal strips stamped into the shape of an open channel having side walls 24, a bottom wall 26 and two lateral flanges 28 which are integral with the side walls 24 along the channel opening. The siding panels 22, which in the illustrated embodiment are corrugated sheet metal panels, are secured to the bottom wall 26 of the sub-girts 20 by self-tapping screws 30. Thermal insulation (not shown) in the form of slabs or batts may be placed between the liner panels 16 and the siding panels 22.

All of the above is conventional except for the special mounting clips 12 of the present invention. Each of the clips 12 includes a planar body 32, which spans the respective sub-girt 20, and inwardly folded-over end portions. In the illustrated embodiment each end portion includes an edge part 34 and an intermediate part 36 bent at a right angle to each other to form an L, and the L is bent inwardly toward the body along a fold line 38 so that the edge part 34 is parallel to the body 32. In an assembled wall the clamping surfaces of the edge part 34 and of the body 32 adjacent the fold line 38 tightly engage thick layers 40 and 42 of thermal insulation and clamp the sub-girt flanges 28 between these layers. The rigidity of the clip body 32 is increased by bending its longitudinal edges toward the center line of the clip 12 thereby forming flanges 33. Other forms of deformation may also be used to impart rigidity to the body 32.

The clips 12 are spaced apart along the length of each sub-girt 20, and each clip 12 is secured to a main girt 14 and/or to a liner panel 16. The outer wall structure, consisting of the sub-girts 20 and the siding panels 22 in the illustrated embodiment, is thereby supported directly or indirectly by the main girts 14. The means for securing each clip 12 may conveniently be a screw 44 or 46 which passes through a pre-formed hole 48 in the body 32 of the clip. As shown, the screw 44 passes through the material of the liner face 17 and directly into a threaded hole in one of the main girts 14. A spacer sleeve 50 is provided between the clip body 32 and the liner face 17 to space the clip 12 and the sub-girt 20 at the desired distance from the main girt 14. The liner panels 16 are thus clamped to the main girts 14 by the sleeves 50. Alternatively, or in addition, separate screws (not shown) may be used to attach the panels 16 to the girts 14. Other clips 12 may be secured directly to the liner panels 16 at the location of the ribs 18 formed by the L-shaped edges of the panels by means of the screws 46 which threadedly engage aligned holes in the double layer of sheet metal which exists at that location.

The wall assembly 10 has been described in terms of a side wall of a building but it will be understood that by wall assembly is meant any wall or roof assembly.

Figure 4:
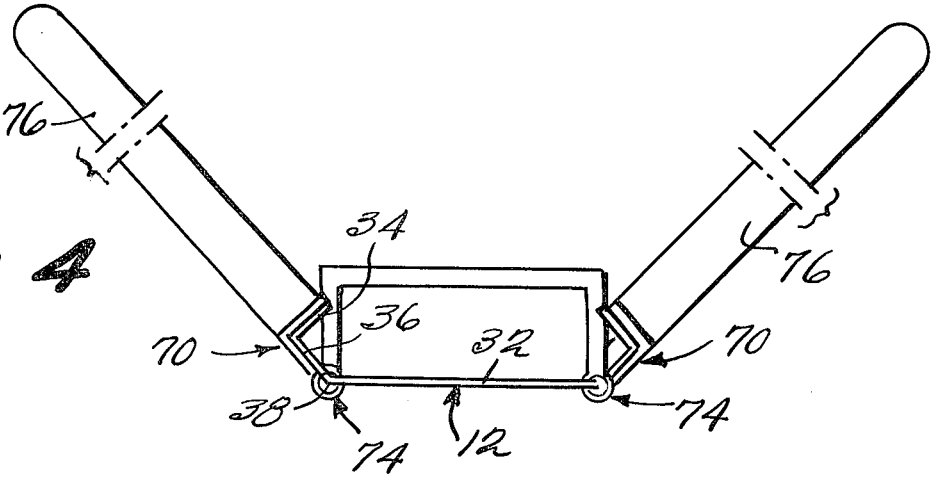
FIG. 4 is an end view of a tool for use with the special mounting means.

The clips 12 may be fabricated by deforming strips of heavy gauge sheet metal to the shape shown in FIG. 4. In this open configuration the L-shaped end portion of each clip 12 lies at about 45° to the body 32 of the clip 12 so that during assembly of a wall of the sub-girts 20 may be placed in position to be clamped by the end portions 34, 36. In one preferred construction the insulation 40,42 is constituted by a single block 52 of material, such as any of a variety of synthetic polymeric resins, manufactured in the shape shown in FIG. 3 and provided with a slot to receive a sub-girt flange 28. In this construction each block 52 is initially held to a flange 28 by friction between the flange 28 and the walls of the slot in the block 52, and the clip is applied subsequently.

Figure 5:
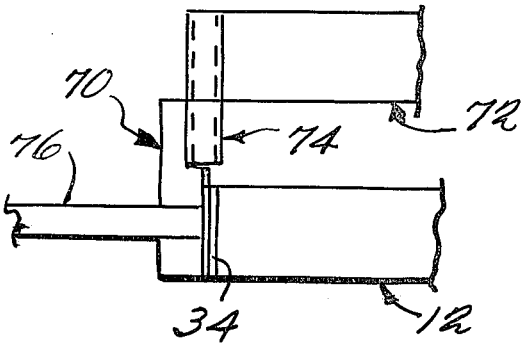
FIG. 5 is a top view of the tool of FIG. 4.

FIGS. 4 and 5 illustrate a tool for folding the end portions of the clips 12 into clamping engagement with the sub-girts 20. The tool includes two rigid angle members 70 which are complementary to the parts 34 and 36 of a clip. A channel-shaped support member 72 is fitted with a hinge 74 at the free end of each leg of the channel, the hinges pivot axes which coincide with the fold lines 38 on the clip 12. A handle 76 is attached at its inner end to each of the angle members 70. In use of the tool an operator grasps one of the handles 76 in each hand and swings both handles toward the clip thereby bending the end parts 36 relative to the body 32, about the fold lines 38, without changing the angles between the end parts 34 and 36.

In assembling the wall assembly 10 in FIGS. 1, 2 and 3 of a plurality of main girts 14 are first installed in any suitable manner in fixed horizontal positions vertically spaced from each other. The liner panels 16 are then attached to the main girts 14 by means of the screw and sleeve assemblies 44, 50 each of which also simultaneously attaches an open clip 12 to the other surfaces of the liner panels 16. Additional open clips 12 may be attached to the panels 16 by screws 46. In either case the open clips 12 are arranged in horizontal, verticlaly-spaced apart rows. A block 52 of thermal insulation is slipped over each sub-girt flange 28 at locations corresponding to the spaces between clips 12 and the sub-girt 20 is laid into the open clips of one of the rows. The operator then applies the clamping tool of FIGS. 4 and 5 to each clip to fold the latter along the fold line 38 from the open position of FIG. 4 to clamped position of FIG. 3. The sub-girts 20 are thereby supported directly or indirectly from the main girts 14. Heat flow from the main girts 14 and from the liner panels 16 to the sub-girts is much reduced by the insulation blocks 52 since these blocks 52 interrupt what would otherwise be a continuous metal-to-metal path between the inner wall structure. The assembly 10 is completed by securing the siding panels 22 to the sub-girts 20 with the screws 30.

Figure 6:
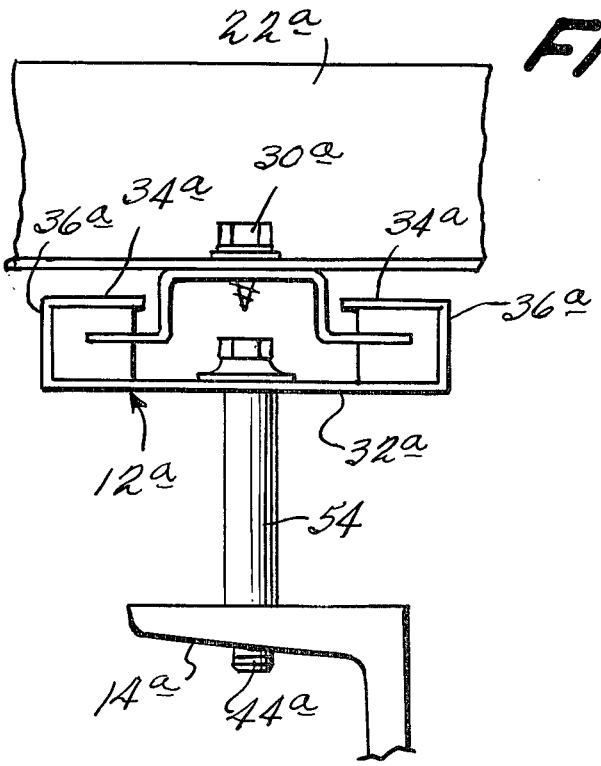
FIG. 6 is a sectional view similar to FIG. 3 illustrating a second embodiment of a clip, which is pressure releasable.
Figure 7:
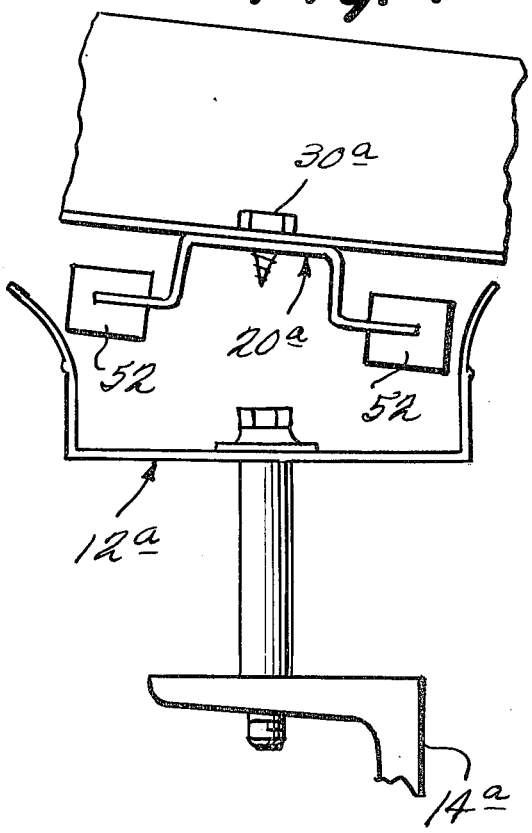
FIG. 7 is a sectional view of the embodiment of FIG. 6 after release of the clip.

FIGS. 6 and 7 illustrate a modified clip construction which provides for venting or pressure release in the event of an accidental explosion within the building. The modified clip **12*a* is the same as the clip 12 in FIGS. 1–5 except that the end portions 34*a* are of less rigid construction than the body 32*a* and the portions 36*a*. In the event of an explosion inside the building the resulting outwardly directed pressure on the siding panels 22*a* will be transmitted to the clip ends 34a which will bend outwardly as shown in FIG. 7, releasing the panels 22*a* and attached sub-girts 20*a* from the clips 12*a* which remain attached to the main girts 14*a*. The reduced rigidity of the ends 34*a* results from the use of thinner metal for these portions of the clips 12*a*. Alternatively weakening holes or weakening slots can be provided along the junction of the portion 34*a* with the portion 36*a*. In the embodiment of FIGS. 6 and 7 the clip 12*a* is secured to the main girt 14*a* by a screw 44*a* and a spacer sleeve 54, and the sub-girt 20*a* is secured to the siding panel 22*a* by a screw 30*a*. There is no liner panel as in FIGS. 1, 2 and 3. A layer of thermal insulation (not shown) in batt or slab form occupies the space between the clip 12*a* and the main girt 12*a*. If the layer of insulation is not needed, the spacer sleeve 54 can be dispensed with and the clip 12*a* attached directly to the main girt 14a**.

Figure 8:
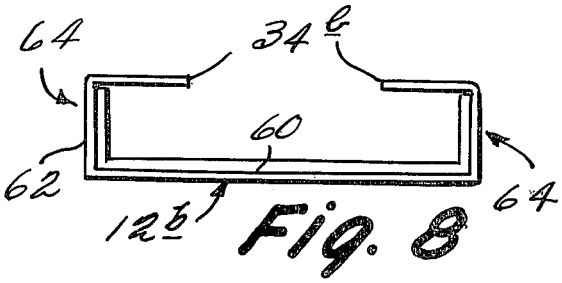
FIG. 8 is a view of a third modification of a clip.

FIG. 8 illustrates a clip **12*b* which is constructed of an inner relatively rigid channel 60 and an outer, less-rigid member 62 the ends 34*b* of which form the releasable portions of the clip 12*b*. The channel 60 and outer member are fastened together by spot welds at locations 64. The channel may be constructed of 18 to 16 gauge sheet metal and the outer member 62** may be constructed of 26 to 24 gauge sheet metal.

Figure 9:
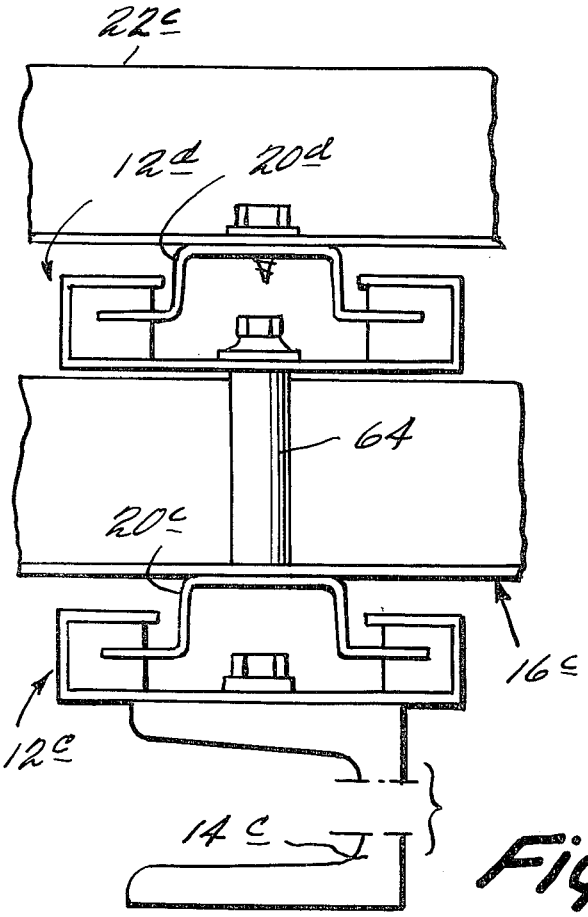
FIG. 9 is a sectional view, similar to FIG. 3, of a further wall construction.

FIG. 9 illustrates a wall assembly which, like the assembly of FIGS. 1, 2 and 3, includes liner panels 16c and siding panels 22c. In this construction an inner pressure-releasable clip 12c is attached directly to the main girt 14c and is releasably clamped to an inner sub-girt 20c. The sub-girt 20c is spaced from an outer non-releasable clip 12d by a screw and sleeve assembly 64. The siding panel 22c fastened to the subgirt 20d. With this construction pressure from an internal explosion is transmitted from the liner panel 16c to the releasable clip 12c so that both panels 16c and 22c separate as a unit from the main girt 14c.

What is claimed is:

1. In a wall assembly: a plurality of elongated, parallel, metal support members mutually spaced apart in a direction transverse to their lengths; a plurality of elongated, parallel metal sub-girts mutually spaced apart in a direction transverse to their lengths, said sub-girts being spaced from said support members; thermally insulating clip assemblies spanning the space between at least some of said support members and at least some of said sub-girts and supporting said sub-girts from said support members; each of said clip assemblies including a clip portion extending transversely of the respective sub-girt and having opposite end portions folded toward the respective sub-girt and clamping each longitudinal edge portion of the respective sub-girt between clamping surfaces on said end portions and clamping surfaces on a central section of the clip portion, with a layer of non-metallic thermally insulating material disposed between each side of each sub-girt edge portion and each adjacent clamping surface, each of said clip assemblies further including means extending transversely of the central section of the respective clip assembly to space said respective central section from the respective support member, said means being connected to said central section and to the respective support member.

2. A wall assembly as in claim 1 wherein said sub-girts are in the form of open channels having bottom walls and side walls provided with lateral flanges, said lateral flanges constituting said longitudinal edge portions of the sub-girts, and wherein the central section of the respective clip portion is a flat section disposed parallel to the bottom wall of the channel.

3. A wall assembly as in claim 1 wherein the means spacing the central section of a clip portion from the respective support member includes a spacing sleeve and fastener member extending through the sleeve and connected to the central section of the clip portion and to the support member.

4. A wall assembly as in claim 1 wherein the central section of each clip portion is flat and wherein the opposite edge portions of the central section is deformed out of the plane of the remainder of the central section.

5. A wall assembly as in claim 4 wherein the deformed edge portions of the central section of the clip portion are flanges folded toward the folded over end portions.

6. A wall assembly as in claim 5 wherein the layers of thermally insulating material in each clip assembly are formed by two blocks of thermally insulating material, each block having a slot in which the respective longitudinal edge portion of the respective sub-girt is disposed, said blocks being disposed between the flanges on said central section.

7. A wall assembly as in claim 1 wherein the layers of thermally insulating material in each clip assembly are in the form of two clocks of thermally insulating material, each block having a slot in which a longitudinal edge portion of the respective sub-girt is disposed, and wherein the means spacing the central section of the clip portion from the respective support member includes a spacing sleeve and a fastening member extending through the sleeve and connected to the support member and to the central section at a location between the two blocks of thermally insulating material.

8. A clip assembly for use in connecting together inner and outer components of a wall assembly, said clip assembly comprising a clip portion which includes a body having two end portions, each end portion being integral with the body and being folded inwardly substantially less than 90° toward the body along a fold line and each end portion having at least one approximately 90° bend, toward said body, which is parallel to said fold line, the folded end portions being acceptable to a leverage tool so as to be further rotated about said fold line, said clip assembly further comprising a spacer portion which includes a sleeve extending perpendicular to the body and a fastener member extending through a hole in said body and longitudinally through said sleeve.

9. A clip assembly as in claim 8 wherein said body is flat and wherein the edges of the body are bent inwardly out of the plane of the remainder of the body to form flanges.

* * * * *